United States Patent [19]

Kucharzyk et al.

[11] 4,313,704

[45] Feb. 2, 1982

[54] GAS-TIGHT CLOSURE

[75] Inventors: Werner Kucharzyk, Essen; Wolfgang Rohde, Essen-Heisingen, both of Fed. Rep. of Germany

[73] Assignees: Bergwerksverband GmbH; Didier Engineering GmbH, both of Essen, Fed. Rep. of Germany

[21] Appl. No.: 32,495

[22] Filed: Apr. 23, 1979

[30] Foreign Application Priority Data

Apr. 22, 1978 [DE] Fed. Rep. of Germany ..... 2817736

[51] Int. Cl.[3] ..... C10J 3/50

[52] U.S. Cl. ..... 414/199; 48/86 R

[58] Field of Search ..... 414/167–171, 414/199–206, 160; 48/86 R

[56] References Cited

U.S. PATENT DOCUMENTS

| | | | |
|---|---|---|---|
| Re. 12,536 | 10/1906 | Baker | 414/203 |
| 1,772,819 | 8/1930 | Schumacher | 48/86 R |
| 2,216,116 | 10/1940 | Koppers | 414/204 |
| 2,599,334 | 6/1952 | Latham | 414/202 |
| 4,162,784 | 7/1979 | Legille et al. | 414/199 |

*Primary Examiner*—Robert G. Sheridan
*Attorney, Agent, or Firm*—Michael J. Striker

[57] ABSTRACT

The gas-tight closure comprises a thin walled tubular piece projecting from a feeding duct into a filling space, a thin walled conical jacket having its larger bottom base provided with a rigid seal reinforcing member cooperating with the lower rim of the intake tubular piece. The outer periphery of the reinforcing member is slanted about a small angle to snugly fit into the tubular piece and adjust the form thereof when upward pull is exerted upon the conical jacket by means of an actuation rod passing outwardly through the wall of the feeding duct. The actuation rod has preferably the form of a hollow shaft which accommodates the manipulation rod of a scraper projecting radially below the reinforcing member into the filling space. The outside portion of the actuation rod is provided with a control device in the form of clamping plates cooperating with abutment plates resting on the guiding sleeve for the actuation rod. The clamping plates are manipulated by means of separate levers.

12 Claims, 2 Drawing Figures

GAS-TIGHT CLOSURE

BACKGROUND OF THE INVENTION

This invention relates gerenally to gas-tight closure and more particularly it relates to a closure for sealingly closing an outlet opening of a feeding duct communicating with a loading space. The closure is provided with a control member which is arranged outside the feeding duct.

Closures of this kind are employed for shutting off feeding streams of different loose materials such as, for example, of preheated coal. The loose material in process is discharged through a feeding duct provided with the open closure into a feeding space which is to be subsequently closed. As soon as the feeding space is charged with the required amount of the material, the flow of the latter is shut off and the inlet opening is hermetically sealed by the closure. Any escape of gases during the closing period both from the charge space and generally from the range above the closing device in the duct should be avoided. Furthermore, it is important that the charge space in the vicinity of the closure should be free of deposited particles so as to insure a flawless feeding operation into the space and a clean seal of the closure.

Closures are known in which the sealing device has approximately a conical configuration having its conical surface (conical jacket) inclined about 45° relative to the axis of the cone which is compressed against the rim of the inlet opening of the space to be charged. This inlet opening usually has a stable knife-edge like rim on its ends to be sealed. A feeding duct through which the loose material flows is fixedly connected to the opposite rim of the inlet opening. The sealing device is axially displaced by means of a spindle or the like, located outside the filling space and operated so as to firmly abut against this inlet opening.

One of the disadvantages of such prior art closures is the fact that particles of the loose material or other foreign bodies which accidentally adhere to the sealing surfaces or the deformations caused by heating effects prevent frequently the closure from establishing a gas-tight seal. Moreover, the force with which the sealing device is compressed on the rim of the inlet opening depends individually on persons operating the closure; it is true, that such known closure might be equipped with a hydraulic or pneumatic control device which exerts a precisely definable force but such control devices require continuous maintenance and attention and under certain circumstances introduce additional disturbing factors.

SUMMARY OF THE INVENTION

It is therefore a general object of the present invention to overcome the aforementioned disadvantages.

More particularly, it is an object of the invention to provide an improved gas-tight closure which is uncomplicated in structure, simple in operation and always insures gas-tight closing.

Another object of the invention is to provide such an improved gas-tight closure which automatically removes impurites from the sealing surfaces.

An additional object of the invention is to provide a gas-tight closure which insures uniform compressing force applied against its sealing surfaces irrespective of the force applied by the operator.

A further object of the invention is to provide means connected to such an improved closure which enable to clean from the outside the inlet region of the charge space as well as the environment of the inlet duct independently from the position of the closure.

In keeping with these objects, and others which will become apparent hereafter, one feature of the invention resides in a gas-tight closure for a feeding duct communicating with a filling space in the provision of a thin walled tubular piece projecting from the outlet opening of the duct into the space, sealing means movable in the tubular piece between a closed position and an open position and including a frustoconical jacket, an actuating rod connected to the smaller top base of the jacket, and an annular seal reinforcing member connected to the rim of the larger bottom base of the jacket, the actuation rod projecting outside the feeding duct and the reinforcing member having a slanted outer edge adapted for snugly fitting into the free rim of the tubular piece whereby the wall of the latter adjusts itself to the shape of the outer edge, and a bushing for sealingly guiding the actuation rod at the point of its passage through the feeding duct.

In the preferred embodiments of this invention the closure is provided with an adjustment member for the sealing means resting on the bushing. This adjusting member includes a pressure spring surrounded by a cylindrical sleeve which supports an abutment for cooperating with clamping plates surrounding the actuation rod. Preferably, the actuation rod is in the form of a hollow shaft through which another rod passes into the space to be charged and is connected at its end with a cleaning scraper, preferably in the form of a rotary blade. In a modification, the cleaning scraper has the form of a tubular cleaner connected to the end of the inner rod by cross-bars whereby the outer cross-section of the tubular cleaner corresponds to the inner cross-section of the inlet range of the space to be charged and closed. The outer rod is actuated, for example, by means of a lever which at one end abuts against a fixed lever member and is pressed counter a biasing spring to axially displace the reinforcing member of the sealing jacket from the rim of the inlet tubular piece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
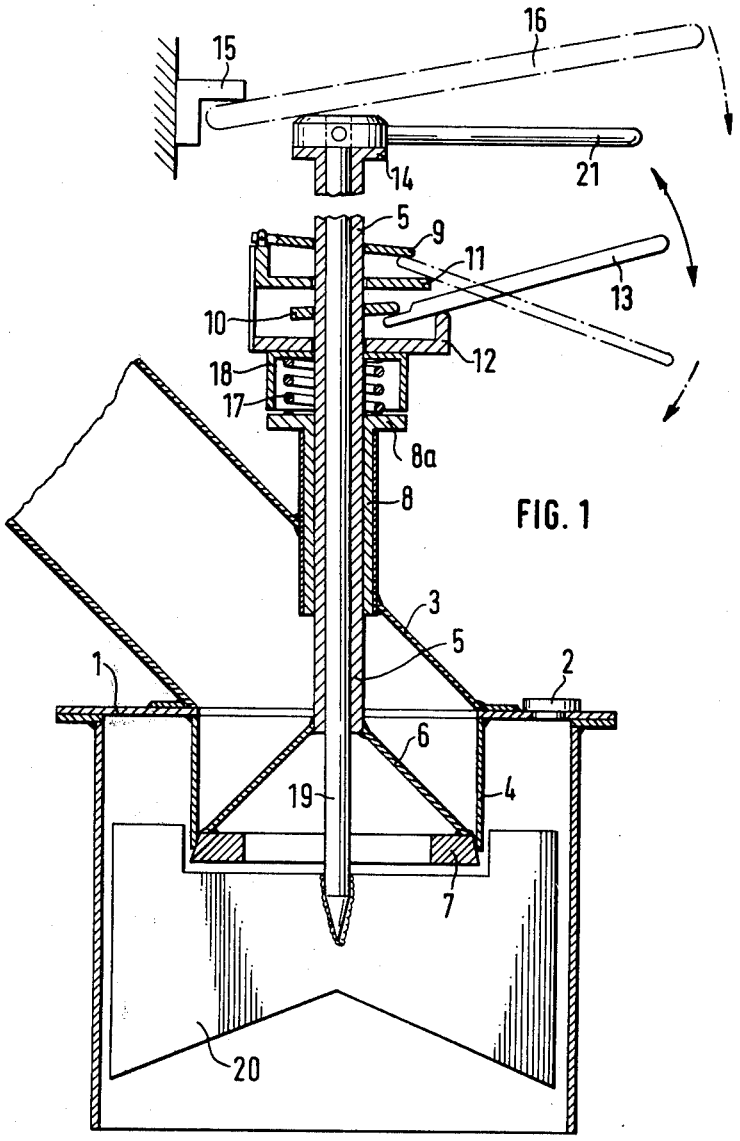
FIG. 1 shows a sectional side view of the gas-tight closure according to this invention in its closing position.

The intake region of the space to be charged and hermetically closed is closed with a cover plate 1 having a viewing hole 2. An inclined feeding tube 3 is secured at its ends to the edge of an inlet opening in the cover plate 1. The sealing device of the gas-tight closure of this invention includes a short tubular piece 4 having relatively thin walls secured at one end to the rim of the inlet opening in the cover plate 1 and projecting to the filling space about a distance which is about half of its diameter. A frustoconical jacket 6 is at its smaller upper base connected to a rod 5 which in this embodiment has the form of a hollow shaft which extends coaxially with the tubular piece 4 upwardly through the wall of the filling duct 3. The larger bottom base of the conical jacket 6 is slightly smaller than the cross-section of the tubular piece 4 and is connected to an annular seal reinforcing member which acts as a plug or stopper. This sealing stopper has preferably the shape of a ring the outer surface of which is slightly inclined towards the free rim of the tubular piece 4. Accordingly, the diameter of the upper face of the annular duct 7 which is attached to the base of the frustoconical jacket 6 is slightly smaller than the diameter of the lower base of the annular reinforcing member 7 so that the latter during the upward movement of the rod 5 is snugly fitted in the lower end of the tubular piece 4 and acts as a plug. By additionally pulling the actuation rod 5 upwardly, the thin wall of the tubular piece 4 adjusts itself to the shape of the reinforcing member 7 and firmly closes the charging space.

It has been found that the closure of this kind is gas-tight even when due to thermal stresses the sealing surfaces of the tubular piece 4 and/or of the reinforcing member 7 are slightly deformed provided that the following provisions are met:

The tubular piece 4 has to be made of a thin walled material (2 mm in the present example); the seal reinforcing member 7 attached to the base of the frustoconical jacket has to be comparatively stable; and the inclination angle of the slanted outer surface of the reinforcing member has to be relatively small relative to the wall of the tubular piece 4 (in the present example the tangent of the inclination angle $\alpha$ is about 0.1).

In this manner the free end of the tubular piece 4 when closed by the rigid seal reinforcing member 7 adjusts itself in form to the latter so that a snug-fit of the two sealing surfaces takes place even then when, for example, due to thermal stresses of one or both sealing parts take place. The reinforcing member 7, however, is not deformable by the forces resulting from the operation of the closure.

The inclination angle $\alpha$ of the outer surface of the closure member cannot, however, be too small but it is to be large enough as to prevent the stopper from sliding into the tubular piece. On the other hand, it cannot be also too large since the deformation of the thin walled tubular piece 4 and thus the gas-tightness of the closure is the better attainable the smaller the inclination angle is. Accordingly, the tangents of the inclination angle $\alpha$ is usually selected to be between 0.05 and 0.5.

The wall thickness of the tubular piece 4 depends on the size of the feeding opening as well as on the kind of thermal and mechanical loads. Nonetheless it must always be selected such that the reinforcing member 7 when subject to appropriate closing forces makes the walls of the tubular piece to adjust itself to the shape of the abutting inclined surface. Generally, the thickness of the wall of the tubular piece is in the range of several millimeters.

Another advantage of the gas-tight closure according to this invention is to be seen in the fact that the sealing inclined surface of the reinforcing member 7 is automatically cleaned by the free edge of the projecting tubular piece 4 so that any loose particles or other impurities accidentally adhering to the sealing surfaces are stripped off during the closing process.

The hollow shaft 5 connected to the top of the conical jacket 6 is guided and sealed in a sealing bushing 8 passing through the wall of the feeding duct 3 opposite the center of the inlet tubular piece 4. The sealing bushing 8 is provided on its upper end with a flange 8*a* for supporting a control device as it will be explained below.

The control device facilitates the control of the axial movement of the hollow shaft with the sealing jacket 6 in such a manner that it can be slowly raised from the charging space or abruptly released to sink again into the latter. This controlling action is possible only when the inclination of the actuation rod or hollow shaft and thus of the whole closure relative to a vertical is not too large, usually not above 45°.

Figure 2:
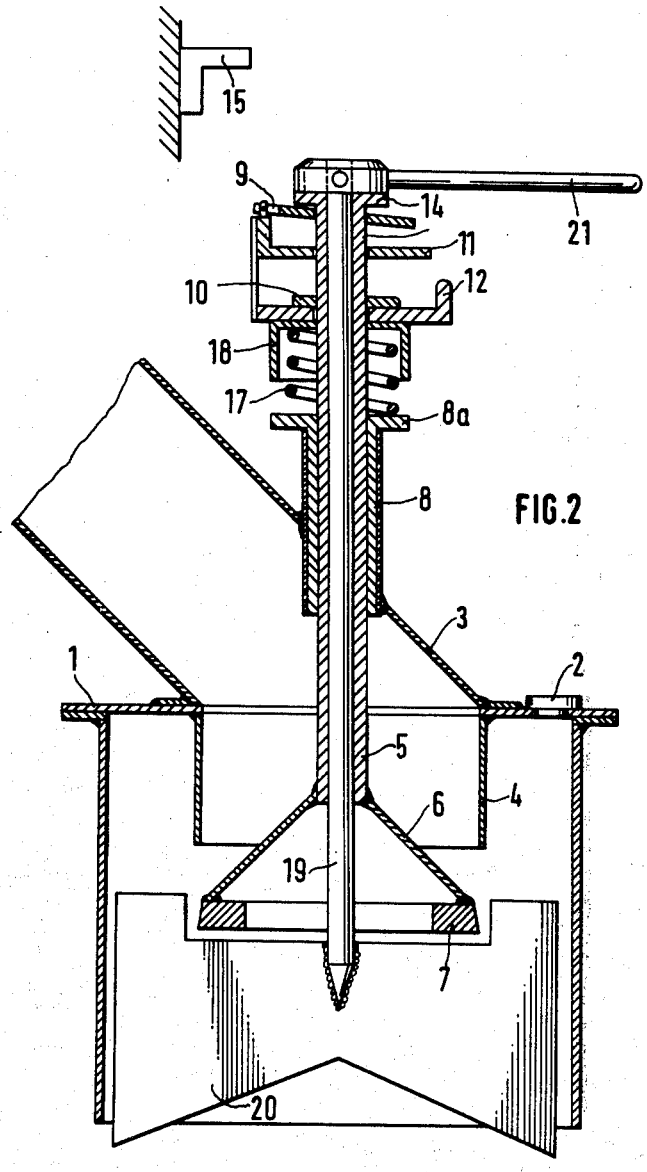
FIG. 2 shows the closure of FIG. 1 in its feeding position.

The control device in the preferred embodiment of this invention as shown in FIGS. 1 and 2 is constituted of two clamping plates 9 and 10 and of abutment members 11 and 12 which are supported on a pressure spring 17 resting on the flange 8*a*. The application of such a control arrangement is known for example in wagon or lifting jacks. By holding the lever 13 against the rim of abutment 12 and inserting the end of the lever 13 below the clamping plate 10, so the rod 5 can be lifted by the lever 13 whereby the upper clamping plate 5 slides along the surface of the rod 5 and clamps the latter as soon as the downward movement of the operating lever 13 is reversed. If however the operating lever 13 is shifted below the upper clamping plate 9 and backed by the upper abutment 11, it is possible to release the clamping position of the upper plate 9 and the hollow shaft 5 slides past the released clamping plate 9 and 10 by its own weight downwardly until its stop 14 abuts against the clamping plate 9. In the event that the seal reinforcing member 7 is fitted into the tubular piece 4 so tightly that the combined weight of the closure and of the control device is insufficient to disengage the seal and clear the opening, an additional pressure is applied against the upper end of the actuation rod 5 by means of an auxiliary lever 16 which is pivotably connected to or inserted in a fixed angular member 15 to exert the necessary additional pressure against the rod 5. The above-described lifting and lowering control device is uncomplicated in structure and can be easily operated.

Another improvement in the device of this invention is obtained by the application of a pressure spring 17 between the sealing bushing 8 and the abutment 12. In the closed state of the tubular piece 4, the spring 17 is compressed with a force corresponding to that at which the reinforcing member 7 has been forced into the tubular piece 4. Preferably, the spring 17 is partially surrounded by a cylindrical sleeve 18 secured to the bottom of the abutment 12 or to the flange 8*a*. The length of the sleeve is adjusted such that the latter acts a force measuring device by means of which it is possible to adjust the contact pressure of the sealing surfaces to be always of the same magnitude. This adjustment can be maintained either by providing such a length of the sleeve 18 that its free end just bears on the flange 8*a* when the desired pressure is attained or when another indexing mark is established, for example, a gap of about 1 mm between the face of the sleeve and the flange of the bushing. A further advantage of the pressure spring 7 is in its impact dampening effect when during the opening of the closure the stop member on the actuation rod 5 drops against the controlling device. The spring thus protects both the controlling device and the sealing bushing and the feeding duct 3.

While the sealing surface of the reinforcing ring, as mentioned above, is automatically cleaned by the free inner edge of the tubular member 4 when the sealing ring is moved into its closing position and, scrapes away loose particles or other impurities accidentally adhering to the sealing surfaces, the outer region surrounding the intake tubular member 4 and the inlet flange of the charging space is cleaned by means of separate cleaning scraper which constitutes a further elaboration of the gas-tight closure of this invention.

This cleaning scraper is attached to a lower end of an axle 19 which passes through the hollow shaft 5 and is held in position by means of a bearing plate supported on the stop member 14 of the shaft 5. The scraper is preferably in the form of rotary blades secured to the lower end of the axle 19 and the latter is rotatable by means of a handle 21 secured to its top end above the stop member 14. The shape of the blades of the scraper 20 is adjusted to the shape of the intake tubular piece 4 and to the size of the charging space. The width of the blades is such that they do not impede the flow of the discharged loose material.

If the cleaning scraper is employed for cleaning surfaces which are not circular in cross-section it is more advantageous to employ a scraper in the form of a tubular cleaner whereby the outer cross-section of the tubular cleaner corresponds to the inner cross-section of the inlet range of the charging space and is connected to the end of axle 19 by means of cross-bars. The cross-bars in a modification, can support additional scraping means. Such tubular scrapers also do not offer any substantial resistance to flow of the discharged loose material. It performs its function by lifting and lowering the axle 19 by means of a conventional operating means such as used for example in hand-operated water pumps.

In some cases it may be desired to combine both kinds of the cleaning scrapers with corresponding actuation devices.

It will be understood that each of the elements described above, or two or more together, may also find a useful application in other types of constructions differing from the types described above. For instance, it not unconditionally necessary that the cleaning devices as illustrated in the Figures be moved together with the hollow shaft 5 but they can be supported on a separate bearing member. The preferred embodiment, as described above, however, has the advantage that the weight of the closure is increased which makes the sliding of the shaft 5 past the clamping plates 9 and 10 more reliable.

While the invention has been illustrated and described as embodied in a specific example of the gas-tight closure, it is not intended to be limited to the details shown, since various modifications and structural changes may be made without departing in any way from the spirit of the present invention.

What is claimed as new and desired to be protected by Letters Patent is set forth in the appended claims:

1. A gas-tight closure for a feeding pipe having an outlet communicating with a filling space, comprising a thin-walled tubular extension projecting from said outlet into said space and having a yieldingly deformable cylindrical free end portion; and sealing means, including a frusto-conical sealing member having a bottom base slightly smaller than the inner radial cross-section of said extension and, connected to said bottom base, a plug-like sealing part defining an upper end and a lower end, the outer surface of said sealing part being slightly inwardly inclined toward said free end so that the radial cross-section of its upper end is slightly smaller and the radial cross-section of its lower end is slightly greater than said inner radial cross-section; and an actuating rod connected to said sealing member and projecting through said extension to the outside of said pipe, said actuating rod being movable between an open position in which said sealing member is spaced from said free end portion and a sealing position in which said sealing member is drawn into said extension and said peripheral edge face yieldingly deforms said cylindrical free end portion to form a seal therewith.

2. The closure as defined in claim 1, said sealing member including an annular reinforcing member mounted on said sealing member at said wider end thereof and having an outer circumference provided with said plug-like sealing part.

3. The closure as defined in claim 2, further including a bushing for sealingly guiding said actuating rod at the point of its passage through the wall of said feeding pipe.

4. The closure as defined in claim 3; wherein said control device includes a plurality of abutments arranged on said bushing around said actuating rod and a corresponding plurality of clamping plates disposed respectively above said abutments.

5. The closure as defined in claim 3 further including a control device for adjusting the position of said sealing means, said control device resting on said bushing.

6. The closure as defined in claim 5; further including a pressure spring arranged around said actuating rod between said bushing and said control device.

7. The closure as defined in claim 6; further including a cylindrical sleeve partially surrounding said spring.

8. The closure as defined in claim 5; wherein said actuating rod is in the form of a hollow shaft.

9. The closure as defined in claim 2; further including a compression lever pivotably supported on a fixed support member and abutting against a top end of said actuating rod to exert thereon pressure in the opening direction of said sealing means.

10. The closure as defined in claim 1, wherein said cleaning scraper has the form of rotatable blades.

11. The closure as defined in claim 1, wherein said cleaning scraper has the form of a tubular cleaner secured to the axle by cross-bars, the outer perimeter of said tubular cleaner corresponding to the inner perimeter of the inlet region of the filling space.

12. A gas-tight closure for a feeding pipe having an outlet communicating with a filling space, comprising a thin-walled tubular extension projecting from said outlet into said space and having a yieldingly deformable cylindrical free end portion; and sealing means, including a frusto-conical sealing member having a narrower end facing inwardly of said extension and a wider end facing outwardly of said extension, said wider end having an outer diameter which is only slightly greater than the inner diameter of said extension and being bounded by a peripheral edge face which tapers in direction towards said narrower end; an actuating hollow shaft connected to said sealing member and projecting through said extension to the outside of said pipe, said actuating hollow shaft being movable between an open position in which said sealing member is spaced from said free end portion and a sealing position in which said sealing member is drawn into said extension and said peripheral edge face yieldingly deforms said cylindrical free end portion to form a seal therewith; said sealing member including an annular reinforcing member mounted on said sealing member at said wider end thereof and having an outer circumference provided with said peripheral edge face; and further including an axle sealingly arranged for axial and angular displacement in said hollow shaft, a lower end portion of said axle extending below said reinforcing member, a cleaning scraper secured to said lower end portion of said axle, and manipulating means attached to the projecting upper end portion and adapted for rotating and lifting said axle.

* * * * *